US007056871B2

(12) United States Patent
Buitrago

(10) Patent No.: US 7,056,871 B2
(45) Date of Patent: Jun. 6, 2006

(54) LUBRICATING OIL COMPOSITION WHICH DECREASES COPPER CORROSION AND METHOD OF MAKING SAME

(75) Inventor: Juan Alberto Buitrago, Pinole, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 135 days.

(21) Appl. No.: 10/424,049

(22) Filed: Apr. 25, 2003

(65) Prior Publication Data

US 2004/0214730 A1 Oct. 28, 2004

(51) Int. Cl.
*C10M 141/10* (2006.01)

(52) U.S. Cl. ..... 508/272; 508/273; 508/306; 508/436; 508/437; 508/569

(58) Field of Classification Search ..... 508/306, 508/272, 273, 274
See application file for complete search history.

(56) References Cited

U.S. PATENT DOCUMENTS

| | | | | |
|---|---|---|---|---|
| 3,901,932 | A | 8/1975 | Tada et al. | |
| 3,923,669 | A | 12/1975 | Newingham et al. | |
| 4,253,977 | A * | 3/1981 | O'Halloran | 508/270 |
| 4,575,431 | A * | 3/1986 | Salentine | 508/159 |
| 4,600,519 | A * | 7/1986 | Gutierrez et al. | 508/306 |
| 5,275,630 | A * | 1/1994 | Dorer | 44/341 |
| 5,342,531 | A * | 8/1994 | Walters et al. | 508/272 |
| 5,372,735 | A | 12/1994 | Ohtani et al. | |
| 5,439,605 | A | 8/1995 | Khorramian | |
| 5,703,023 | A | 12/1997 | Srinivasan | |
| 5,801,130 | A * | 9/1998 | Francisco et al. | 508/272 |
| 6,362,137 | B1 * | 3/2002 | Bhatnagar et al. | 508/273 |
| 6,413,916 | B1 | 7/2002 | Baumgart et al. | |
| 6,528,458 | B1 * | 3/2003 | Tagliamonte et al. | 508/185 |
| 6,573,223 | B1 * | 6/2003 | Vinci | 508/192 |
| 6,617,287 | B1 * | 9/2003 | Gahagan et al. | 508/192 |
| 6,689,723 | B1 | 2/2004 | Sullivan et al. | |
| 6,797,679 | B1 * | 9/2004 | Kawasaki et al. | 508/272 |

FOREIGN PATENT DOCUMENTS

| | | |
|---|---|---|
| EP | 0 519 760 A1 | 12/1992 |
| EP | 0 926 224 A2 | 6/1999 |
| WO | WO 98/16669 | 4/1998 |
| WO | WO 01/71640 A1 | 9/2001 |

* cited by examiner

*Primary Examiner*—Ellen M. McAvoy
(74) *Attorney, Agent, or Firm*—Josetta I. Jones

(57) ABSTRACT

An oil-soluble additive composition and lubricating oil composition containing the same, comprising an organic sulfur-containing extreme pressure additive; a thiadiazole, wherein the thiadiazole does not contain a polycarboxylate moiety and the amount of dimercaptothiadiazole is from about 0.1 wt % to about 10 wt %; an amino phosphorus compound; and an alkyl or alkenyl succinic anhydride, used to reduce the corrosion of yellow metal components which are present in axles and transmissions.

16 Claims, No Drawings

LUBRICATING OIL COMPOSITION WHICH DECREASES COPPER CORROSION AND METHOD OF MAKING SAME

BACKGROUND OF THE INVENTION

1. Field of the Invention

This invention relates to the manufacture and composition of gear oil additives used to decrease the corrosion of yellow metal components which are present in axles and transmissions. This corrosion may occur from the use of sulfurized olefins in the gear oil.

2. Background

In gear oil applications, sulfurized olefins are typically used to protect gears from scoring. However, these sulfur compounds are extremely corrosive towards yellow metals, such as copper and copper alloys. The sulfur components in combination with phosphorus components produce a composition that degrades the copper. Gear oil specifications have minimum requirements for copper corrosion. For example, API GL-5 category requires a maximum rating of 3 in the ASTM D-130 test. Typically, to decrease copper corrosion, copper passivators, such as thiadiazoles and triazoles, are added in enough quantities until the lubricating oil has an acceptable copper corrosion performance. The addition of copper passivators is costly. Therefore, a new, cost efficient gear oil additive has been discovered that decreases copper corrosion as well as decreases the cost of the gear oil additive.

Van Der Veer et al., International Publication Number WO 98/16669, disclose a corrosion inhibiting composition that comprises at least (A) a carrier of an oily or waxy type; and (B) active components comprising at least (B1) a corrosion-inhibitor of the azole-type, and (B2) a co-corrision-inhibitior, selected from the group consisting of (a) aromatic acids and naphthenic acids, which acids have the free acid form or the alkaline, alkaline earth, ammonium and/or amine salt form, with the proviso that sodium benzoate is excluded, (b) imidazoline derivatives having a $C_{6-24}$ alkyl moiety, and (c) $C_{6-24}$ alkyl and alkenyl succinic acids including the anhydride compounds thereof, as well as mixtures of compounds defined under (a), (b) and/or (c). Typically, this component is used to decrease the corrosion of elongated objects of steel.

Junga, International Publication Number WO 94/17164, discloses an anti-wear, high pressure hydraulic oil which contains essentially no zinc or phosphorus. The hydraulic oil protects against corrosion and oxidation as well as provides anti-wear, anti-weld, and demulsibility properties. The hydraulic oil contains (1) petroleum hydrocarbon oil; (2) esters of dibasic and monobasic acids; (3) butylated phenol; (4) phenol; (5) sulfurized fatty oil; (6) fatty acid; and (7) sulfur scavenger.

Baumgart et al., U.S. Pat. No. 6,413,916, disclose a lubricant composition that deposits a corrosion protective coating on the surface which prevents corrosion and reduces wear. The composition comprises a light mineral oil of high purity, a molybdenum based lubricant, a metal sulfonate such as calcium sulfonate, a long chain fatty acid, ZDP, a zinc dithiophosphate derivative and more particularly a zinc alkyldithiophosphate, or diazole such as thiadiazole derivative.

Khorramian, U.S. Pat. No. 5,439,605, discloses a base oil that contains a copper passivator. The copper passivator is preferably a benzotriazole derivative such as 1H-benzotriazole-1-Methanamine,N,N-bis(2-ethyl hexyl)-methyl; and the copper passivator is preferably present in the final zinc dialkyldithiophosphate (ZDTP)-free, with or without phosphorus, low ash or light ash lubricating oil.

Newingham et al., U.S. Pat. No. 3,923,669, disclose an anti-wear hydraulic oil that comprises major amounts of a mineral lubricating oil and minor amounts of a secondary zinc dialkyl dithiophosphate anti-wear agent, chelating type and film forming type metal deactivators, a neutral barium salt of a petroleum sulfonate, and a succinic acid based rust inhibitor.

Taguchi et al., European Patent Application No. EP 0926 224 A2, disclose the addition of a compound which is composed of at least one cyclic dicarboxylic acid anhydride substituted by one or more specific alkyl or alkenyl groups, in an effective proportion to a lubricating base stock. The addition of this compound provides a lubricating oil composition for an automatic or continuously variable transmission which achieves a sufficient friction coefficient in a high sliding speed range while retaining lubricating oil properties required as a lubricating oil for the automatic or continuously variable transmission.

SUMMARY OF THE INVENTION

A novel gear oil composition has been discovered that decreases the corrosion of yellow metal components of axles and transmissions, particularly copper and copper alloys. A gear oil composition comprising a sulfur component, a phosphorus component, a thiadiazole, and an alkyl or alkenyl succinic anhydride in an oil of lubricating viscosity has been found to decrease the copper corrosion of gears. Specifically, the combination of the thiadiazole and the alkyl or alkenyl succinic anhydride works to decrease the corrosion of the yellow metal components in gears that occurs from contact with sulfur and phosphorus compounds.

The present invention provides a gear oil additive package that may be used in a gear lubricating oil.

The present invention further provides a novel process for preparing an additive composition that may be used in a gear lubricating oil.

Moreover, the present invention also provides a lubricating oil composition and method of use of the lubricating oil containing the additive composition of the invention.

Accordingly, in one aspect, the present invention is directed to an oil-soluble additive composition comprising:

(a) an organic sulfur-containing extreme pressure additive;

(b) a thiadiazole, wherein the thiadiazole does not contain a polycarboxylate moiety and the amount of dimercaptothiadiazole present in the thiadiazole is from about 0.1 wt % to about 10 wt %;

(c) an amino phosphorus compound; and (d) an alkyl or alkenyl succinic anhydride, wherein the alkyl or alkenyl group has a number average molecular weight from about 160 to about 700.

In another aspect, the present invention is directed to a lubricating oil composition comprising:

(a) a major amount of oil of lubricating viscosity; and (b) a minor amount of an oil-soluble additive composition comprising:

(i) an organic sulfur-containing extreme pressure additive, (ii) an amino phosphorus compound, (iii) a thiadiazole, wherein the thiadiazole does not contain a polycarboxylate moiety and the amount of dimercaptothiadiazole present in the thiadiazole is from about 0.1 wt % to about 10 wt %, and (iv) an alkyl or alkenyl succinic anhydride, wherein the alkyl or alkenyl group of the alkyl or alkenyl succinic anhydride has a number average molecular weight of from about 160 to about 700.

In a preferred embodiment, the present invention provides a lubricating oil composition comprising:

(a) a major amount of oil of lubricating viscosity;

(b) from about 0.25 to about 3.6 wt % of an organic sulfur-containing extreme pressure additive;

(c) from about 0.3 to about 1.5 wt % of an amino phosphorus compound;

(d) from about 0.01 to about 1.2 wt % of an alkyl or alkenyl succinic anhydride, wherein the alkyl or alkenyl group has a number average molecular weight from about 160 to about 700; and (e) from about 0.02 to about 0.25 wt % of a thiadiazole, wherein the thiadiazole does not contain a polycarboxylate moiety and the amount of dimercaptothiadiazole present in the thiadiazole is from about 0.1 wt % to about 10 wt %.

The present invention also provides a method of making an oil-soluble additive composition comprising:

(a) preparing a base package by mixing an organic sulfur-containing extreme pressure additive with an amino phosphorus compound; and (b) mixing the product of (a) with an alkyl or alkenyl succinic anhydride, wherein the alkyl or alkenyl group has a number average molecular weight of about 160 to about 700, and a thiadiazole, wherein the thiadiazole does not contain a polycarboxylate moiety and the amount of dimercaptothiadiazole present in the thiadiazole is from about 0.1 wt % to about 10 wt %.

The present invention additionally provides a method of making a lubricating oil composition comprising:

(a) preparing a base package by mixing an organic sulfur-containing extreme pressure additive with an amino phosphorus compound;

(b) mixing the product of (a) with an alkyl or alkenyl succinic anhydride, wherein the alkyl or alkenyl group has a number average molecular weight of about 160 to about 700, and a thiadiazole, wherein the thiadiazole does not contain a polycarboxylate moiety and the amount of dimercaptothiadiazole present in the thiadiazole is from about 0.1 wt % to about 10 wt %; and (c) combining the product of (b) with a major amount of oil of lubricating viscosity.

The present invention further provides a method of making a lubricating oil composition comprising:

(a) mixing an organic sulfur-containing extreme pressure additive, an amino phosphorus compound, an alkyl or alkenyl succinic anhydride, wherein the alkyl or alkenyl group has a number average molecular weight of about 160 to about 700, and a thiadiazole, wherein the thiadiazole does not contain a polycarboxylate moiety and an amount of dimercaptothiadiazole present in the thiadiazole is from about 0.1 wt % to about 10 wt %, until the mixture is homogenous; and (b) adding at least 90 wt % base oil to the mixture of (a).

DETAILED DESCRIPTION OF THE INVENTION

The Additive Package

The gear oil additive package of the present invention is an oil-soluble additive composition. The gear oil additive package may be used in a gear lubricating oil. The additive package of the present invention comprises an organic sulfur-containing extreme pressure (EP) additive; an alkyl or alkenyl succinic anhydride; an amino phosphorus compound; and a thiadiazole corrosion inhibitor.

The organic sulfur-containing extreme pressure additive will typically be an organic polysulfide. Preferably, the organic sulfur-containing extreme pressure additive is a dialkyl polysulfide or mixture of dialkyl polysulfides. More preferably, the organic polysulfide is a mixture of di-t-butyl tri-, tetra-, and penta-sulfide, such as the di-tertiary-butyl polysulfide known as TBPS 454, which may be obtained from Chevron Phillips Chemical Company, Houston, Tex.

Cross-sulfurized ester olefins, such as a sulfurized mixture of $C_{10}$–$C_{25}$ olefins with fatty acid esters of $C_{10}$–$C_{25}$ fatty acids and $C_1$–$C_{25}$ alkyl or alkenyl alcohols, wherein the fatty acid and/or the alcohol is unsaturated may also be used as the sulfur-containing extreme pressure additive.

Sulfurized olefins, which may also be employed in the present invention, are typically prepared by the reaction of a $C_3$–$C_6$ olefin, including sulfurized isobutylene, or a low-molecular-weight polyolefin derived therefrom with a sulfur-containing compound such as sulfur, sulfur monochloride, and/or sulfur dichloride.

The succinic anhydride component of the present gear oil additive composition is an alkyl or alkenyl succinic anhydride, wherein the alkyl or alkenyl group has a number average molecular weight of about 160 to about 700. Preferably, the succinic anhydride is an alkenyl succinic anhydride. Preferred alkenyl succinic anhydrides include tetrapropenyl succinic anhydride and polyisobutenyl succinic anhydride. When the alkenyl succinic anhydride is a polyisobutenyl succinic anhydride, the polyisobutenyl group will preferably have a molecular weight of about 250 to about 700, more preferably about 450 to about 650, and most preferably about 500 to about 600. A particularly preferred polyisobutenyl group will have a molecular weight of about 550. If polyisobutenyl succinic anhydride (PIBSA) is used, then the PIBSA can be prepared by a number of methods. Harrison et al., U.S. Pat. No. 6,156,850, herein incorporated by reference, is one example of preparing PIBSA by a thermal reaction. Other methods of PIBSA preparation include using a chlorinated polyisobutene as disclosed in Meinhardt et al., U.S. Pat. No. 4,234,435, The amino phosphorus compound may be a phosphorus compound as described in Salentine, U.S. Pat. No. 4,575,431, the disclosure of which is herein incorporated by reference. Preferably, the amino phosphorus compound is an amine dithiophosphate. Typical dithiophosphates useful in the lubricant of the present invention are well known in the art. These dithiophosphates are those containing two hydrocarbyl groups and one hydrogen functionality, and are therefore acidic. The hydrocarbyl groups useful herein are preferably aliphatic alkyl groups of 3 to 8 carbon atoms.

Representative dihydrocarbyl dithiophosphates include di-2-ethyl-1-hexyl hydrogen dithiophosphate, diisoctyl hydrogen dithiophosphate, dipropyl hydrogen dithiophosphate, and di-4-methyl-2-pentyl hydrogen dithiophosphate.

Preferred dithiophosphates are dihexyl hydrogen dithiophosphate, dibutyl hydrogen dithiophosphate, and di-n-hexyl hydrogen dithiophosphate.

For use in the present invention, acidic phosphates are partially or completely neutralized by reaction with alkylamines. A mixture of acidic phosphates may also be used. The resulting composition is a complex mixture of alkylammonium salts, mixed acid-alkylammonium salts and acids of the sulfur-free mono and dihydrocarbyl phosphates and alkylammonium salts and free acids of the dihydrocarbyl dithiophosphates. Neutralization must be at least 50%, preferably at least 80% complete. For best results, neutralization should be in the range of 85% to 95%, wherein 100% neutralization refers to the reaction of one alkylamine with each acid hydrogen atom.

The amine moiety is typically derived from an alkylamine. The amine alkyl group is from 10 to 30, preferably 12 to 18 carbons in length. Typical amines include pentadecylamine, octadecylamine, cetylamine, and the like. Most preferred is oleylamine. When using a mixture of dithiophosphates and sulfur-free phosphates, the mole ratio of the dithiophosphates to the sulfur-free phosphates should be in the range of 70:30 to 30:70, preferably 55:45 to 45:55, and most preferably 1:1. The mole ratio of the substituted dihydrogen phosphates to the disubstituted hydrogen phosphates should be in the range 30:70 to 55:45, preferably 35:65 to 50:50, and most preferably 45:55.

The thiadiazole component of the present additive composition is a non-polycarboxylate moiety-containing thiadiazole. Preferably, the thiadiazole comprises at least one of 2,5-dimercapto-1,3,4-thiadiazole; 2-mercapto-5-hydrocarbylthio-1,3,4-thiadiazoles; 2-mercapto-5-hydrocarbyldithio-1,3,4-thiadiazoles; 2,5-bis(hydrocarbylthio and 2,5-bis(hydrocarbyldithio)-1,3,4-thiadiazoles. The more preferred compounds are the 1,3,4-thiadiazoles, especially the 2-hydrocarbyidithio-5-mercapto-1,3,4-dithiadiazoles and the 2,5-bis(hydrocarbyidithio)-1,3,4-thiadiazoles, a number of which are available as articles of commerce. Most preferably, a non-polycarboxylate-containing thiadiazole containing about 4.0 wt % 2,5-dimercapto-1,3,4-thiadiazole, which may be either Ethyl Corporation's Hitec® 4313 or Lubrizol Corporation's Lubrizol® 5955A, is used. Hitec® 4313 may be obtained from Ethyl Corporation, Richmond, Va. and Lubrizol® 5955A may be obtained from Lubrizol Corporation, Wycliffe, Ohio. The preferred amount of dimercaptothiadiazole present in the thiadiazole used in the present invention is from about 0.1 wt % to about 10.0 wt %; more preferred 2.0 wt % to about 6.0 wt %; and most preferred 4.0 wt %.

In the Comparative Examples herein, Vaniube 871, which is 2,5-dimercapto-1,3,4-thiadiazole having an alkyl polycarboxylate moiety, was used instead of Hitec® 4313 or Lubrizol® 5955A. It was found that using Vanlube 871 did not decrease copper corrosion (see Comparative Examples and Performance Results: Examples I, K and O). Also in the Comparative Examples, Mobilad C610 was used instead of Hitec® 4313 or Lubrizol® 5955A. Using Mobilad C610 also did not decrease copper corrosion (see Comparative Examples and Performance Results: Examples J, N and R). Carbon—NMR and Infrared (IR) analyses of Mobilad C610 suggest that MobiladC610 only has trace amounts (i.e., approximately 0.01 wt %) of dimercaptothiadiazole.

The Lubricating Oil Composition

The organic sulfur-containing extreme pressure additive, amino phosphorus compound, thiadiazole corrosion inhibitor and alkyl or alkenyl succinic anhydride are generally added to a base oil that is sufficient to lubricate gears and other components which are present in axles and transmissions. Typically, the lubricating oil composition of the present invention comprises a major amount of oil of lubricating viscosity and a minor amount of the gear oil additive package.

Specifically, the lubricating oil composition comprises preferably from about 0.25 wt % to about 3.6 wt % organic sulfur-containing EP additive, such as a mixture of di-t-butyl tri-, tetra-, and penta-sulfide. More preferably, from about 1.2 wt % to about 2.6 wt % sulfur-containing EP additive, such as a mixture of di-t-butyl tri-, tetra-, and penta-sulfide, is present in the lubricating oil composition. Most preferably, from about 1.4 wt % to about 2.2 wt % sulfur-containing EP additive, such as a mixture of di-t-butyl tri-, tetra-, and penta-sulfide, is present in the lubricating oil composition. Preferably, from about 0.3 wt % to about 1.5 wt % amino phosphorus compound, such as amine dithiophosphate, is in the lubricating oil composition. More preferably, from about 0.7 wt % to about 1.3 wt % amino phosphorus compound is in the lubricating oil composition. Most preferably, from about 0.8 wt % to about 1.2 wt % amino phosphorus compound is in the lubricating oil composition. Preferably, from about 0.01 wt % to about 1.20 wt % alkyl or alkenyl succinic anhydride, such as tetrapropenyl succinic anhydride or polyisobutenyl succinic anhydride, is in the lubricating oil composition. More preferably, from about 0.10 wt % to about 0.75 wt % of alkyl or alkenyl succinic anhydride, such as tetrapropenyl succinic anhydride or polyisobutenyl succinic anhydride, is in the lubricating oil composition. Most preferably, from about 0.25 wt % to about 0.60 wt % alkyl or alkenyl succinic anhydride, such as tetrapropenyl succinic anhydride or polyisobutenyl succinic anhydride, is in the lubricating oil composition. Preferably, from about 0.02 wt % to about 0.25 wt % thiadiazole, such as a non-alkyl-polycarboxylate moiety-containing 2,5-dimercapto-1,3,4-thiadiazole, is in the lubricating oil composition. More preferably, about 0.05 wt % to about 0.20 wt % thiadiazole, such as a non-alkyl-polycarboxylate moiety-containing 2,5-dimercapto-1,3,4-thiadiazole, is in the lubricating oil composition. Most preferably, from about 0.1 wt % to about 0.18 wt % thiadiazole, such as a non-alkyl-polycarboxylate moiety-containing 2,5-dimercapto-1,3,4-thiadiazole, is in the lubricating oil composition.

The base oil employed may be any of a wide variety of oils of lubricating viscosity. The base oil of lubricating viscosity used in such compositions may be mineral oils or synthetic oils. A base oil having a viscosity of at least 2.5 cSt at 40° C. and a pour point below 20° C., preferably at or below 0° C., is desirable. The base oils may be derived from synthetic or natural sources. Mineral oils for use as the base oil in this invention include, for example, paraffinic, naphthenic and other oils that are ordinarily used in lubricating oil compositions. Synthetic oils include, for example, both hydrocarbon synthetic oils and synthetic esters and mixtures thereof having the desired viscosity. Hydrocarbon synthetic oils may include, for example, oils prepared from the polymerization of ethylene, polyalphaolefin or PAO oils, or oils prepared from hydrocarbon synthesis procedures using carbon monoxide and hydrogen gases such as in a Fisher-Tropsch process. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity, such as didodecyl benzene, can be used. Useful synthetic esters include the esters of monocarboxylic acids and polycarboxylic acids, as well as mono-hydroxy alkanols and polyols. Typical examples are didodecyl adipate, pentaerythritol tetracaproate, di-2-ethylhexyl adipate, dilaurylsebacate, and the like. Complex esters prepared from mixtures of mono and dicarboxylic acids and mono and dihydroxy alkanols can also be used. Blends of mineral oils with synthetic oils are also useful.

Thus, the base oil can be a refined paraffin type base oil, a refined naphthenic base oil, or a synthetic hydrocarbon or non-hydrocarbon oil of lubricating viscosity. The base oil can also be a mixture of mineral and synthetic oils. Most preferred is a Group I base oil.

Additionally, other additives well known in lubricating oil compositions may be added to the additive composition of the present invention to complete a finished oil.

Other Additives

The following additive components are examples of some of the components that can be favorably employed in the present invention. These examples of additives are provided to illustrate the present invention, but they are not intended to limit it:

1. Metal Detergents
   Sulfurized or unsulfurized alkyl or alkenyl phenates, alkyl or alkenyl aromatic sulfonates, borated sulfonates, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multiacid, and chemical and physical mixtures thereof.

2. Anti-Oxidants
   Anti-oxidants reduce the tendency of mineral oils to deteriorate in service which deterioration is evidenced by the products of oxidation such as sludge and varnish-like deposits on the metal surfaces and by an increase in viscosity. Examples of anti-oxidants useful in the present invention include, but are not limited to, phenol type (phenolic) oxidation inhibitors, such as 4,4'-methylene-bis(2,6-di-tert-butylphenol), 4,4'-bis(2,6-di-tert-butylphenol), *but,4'-bis(2-methyl-6-tert-butylphenol), 2,2'-methylene-bis(4-methyl-6-tert-butylphenol), 4,4'-butylidene-bis(3-methyl-6-tert-butyl phenol), 4,4'-isopropylidene-bis(2,6-di-tert-butylphenol), 2,2'-methylene-bis(4-methyl-6-nonylphenol), 2,2'-isobutylidene-bis(4,6-dimethylphenol), 2,2'-5-methylene-bis(4-methyl-6-cyclohexylphenol), 2,6-di-tert-butyl-4-methylphenol, 2,6-di-tert-butyl-4-ethylphenol, 2,4-dimethyl-6-tert-butyl-phenol, 2,6-di-tert-1-dimethylamino-p-cresol, 2,6-di-tert-4-(N,N'-dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-10-butylbenzyl)-sulfide, and bis(3,5-di-tert-butyl-4-hydroxybenzyl). Diphenylamine-type oxidation inhibitors include, but are not limited to, alkylated diphenylamine, phenyl-.alpha.-naphthylamine, and alkylated-.alpha.-naphthylamine. Other types of oxidation inhibitors include metal dithiocarbamate (e.g., zinc dithiocarbamate), and 15-methylenebis(dibutyidithiocarbamate).

3. Anti-Wear Agents
   As their name implies, these agents reduce wear of moving metallic parts. Examples of such agents include, but are not limited to, phosphates, carbarnates, esters, and molybdenum complexes.

4. Rust Inhibitors (Anti-Rust Agents)
   a) Nonionic polyoxyethylene surface active agents: polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol mono-oleate, and polyethylene glycol mono-oleate.
   b) Other compounds: stearic acid and other fatty acids, dicarboxylic acids, metal soaps, fatty acid amine salts, metal salts of heavy sulfonic acid, partial carboxylic acid ester of polyhydric alcohol, and phosphoric ester.

5. Demulsifiers
   Addition product of alkylphenol and ethylene oxide, polyoxyethylene alkyl ether, and polyoxyethylene sorbitan ester.

6. Extreme Pressure Anti-Wear Agents (EP/AW Agents)
   Zinc dialky-1-dithiophosphate (primary alkyl, secondary alkyl, and aryl type), diphenyl sulfide, methyltrichlorostearate, chlorinated naphthalene, fluoroalkylpolysiloxane, lead naphthenate, neutralized phosphates, dithiophosphates, and sulfur-free phosphates.

7. Friction Modifiers
   Fatty alcohol, fatty acid, amine, borated ester, other esters, phosphates, phosphites and phosphonates.

8. Multifunctional Additives
   Sulfurized oxymolybdenum dithiocarbamate, sulfurized oxymolybdenum organo phosphorodithioate, oxymolybdenum monoglyceride, oxymolybdenum diethylate amide, amine-molybdenum complex compound, and sulfur-containing molybdenum complex compound.

9. Viscosity Index Improvers
   Polymethacrylate type polymers, ethylene-propylene copolymers, styrene-isoprene copolymers, hydrated styrene-isoprene copolymers, polyisobutylene, and dispersant type viscosity index improvers.

10. Pour Point Depressants
    Polymethyl methacrylate.

11. Foam Inhibitors
    Alkyl methacrylate polymers and dimethyl silicone polymers.

12. Metal Deactivators
    Disalicylidene propylenediamine, triazole derivatives, mercaptobenzothiazoles, and mercaptobenzimidazoles.

13. Dispersants
    Alkenyl succinimides, alkenyl succinimides modified with other organic compounds, alkenyl succinimides modified by post-treatment with ethylene carbonate or boric acid, pentaerythritols, phenate-salicylates and their post-treated analogs, alkali metal or mixed alkali metal, alkaline earth metal borates, dispersions of hydrated alkali metal borates, dispersions of alkaline-earth metal borates, polyamide ashless dispersants and the like or mixtures of such dispersants.

Method of Making Additive Package

The gear oil additive package is prepared by mixing the following four components at elevated temperatures of about 50° F. to 150° F., for example at about 100° F.: (a) an organic sulfur-containing extreme pressure additive, such as a mixture of di-t-butyl tri-, tetra-, and penta-sulfide; (b) an amino phosphorus compound, such as an amine dithiophosphate; (c) an alkyl or alkenyl succinic anhydride; and (d) a thiadiazole, such as dimercaptothiadiazole. Preferably, the alkyl or alkenyl succinic anhydride is tetrapropenyl succinic anhydride or polyisobutenyl succinic anhydride wherein the alkenyl group has a number average molecular weight from about 160 to about 700. A particularly preferred polyisobutenyl group has a number average molecular weight of about 550 derived from a 550 molecular weight polyisobutene that may be obtained from BASF in Ludwigshafen, Germany under the trade name Glissopal 550. Preferably, from about 30 wt % to about 70 wt % sulfur-containing EP additive is used in the mixture. More preferably, from about 35 wt % to about 65 wt % sulfur-containing EP additive is used in the mixture. Most preferably, from about 40 wt % to about 50 wt % sulfur-containing EP additive is used in the mixture. Preferably, from about 10 wt % to about 60 wt % amino phosphorus compound is added to the mixture. More preferably, from about 15 wt % to about 55 wt % amino phosphorus compound is added to the mixture. Most preferably, from about 20 to 50 wt % amino phosphorus compound is added to the mixture. Preferably, from about 0.5 wt % to about 30 wt % alkyl or alkenyl succinic anhydride is added to the mixture. More preferably, from about 0.5 wt % to about 25 wt % of alkyl or alkenyl succinic anhydride is added to the mixture. Most preferably, from about 1 wt % to about 20 wt % alkyl or alkenyl succinic anhydride is added to the mixture. Preferably, from about 0.5 wt % to about 15 wt % thiadiazole, such as a non-alkyl-polycarboxylate moiety-containing 2,5-dimercapto-1,3,4-thiadiazole, is added to the mixture. More preferably, 1 wt % to about 10 wt % thiadiazole, such as a non-alkyl-polycarboxylate moiety-containing 2,5-dimercapto-1,3,4-thiadiazole, is added to the mixture. Most preferably, from about 2 wt % to about 5 wt % thiadiazole, such as a non-alkyl-polycarboxylate moiety-containing 2,5-dimercapto-1,3,4-thiadiazole, is added to the mixture.

The Finished Oil of the Present Invention

A first process for making the finished oil requires the addition of the additive package described above to an oil of lubricating viscosity.

A second process for making the finished oil first requires blending a base package. The base package is prepared by mixing the sulfur-containing EP additive, such as a mixture of di-t-butyl tri-, tetra-, and penta-sulfide, with the amino phosphorus compound at elevated temperatures of about 50° F. to 150° F., such as 100° F., until the mixture is homogenous. Preferably, from about 35 wt % to about 80 wt % sulfur-containing EP additive is used in the base package. More preferably, from about 40 wt % to about 75 wt % sulfur-containing EP additive is used in the base package. Most preferably, from about 45 wt % to about 70 wt % sulfur-containing EP additive is used in the base package. Preferably, from about 20 wt % to about 65 wt % amino phosphorus compound is used in the base package. More preferably, from about 25 wt % to about 60 wt % amino phosphorus compound is used in the base package. Most preferably, from about 30 wt % to about 55 wt % amino phosphorus compound is used in the base package.

Preferably, from about 0.6 wt % to about 5 wt % of the base package is used in the blend of the finished oil. More preferably, from about 2 wt % to about 4 wt % of the base package is used in the blend of the finished oil. Most preferably, from about 2 wt % to about 3 wt % of the base package is used in the blend of the finished oil. An alkyl or alkenyl succinic anhydride is added to the prepared base package. Preferably, the alkyl or alkenyl succinic anhydride is tetrapropenyl succinic anhydride or polyisobutenyl succinic anhydride wherein the alkyl or alkenyl group has a number average molecular weight from about 160 to about 700. More preferred, the polyisobutenyl group has a number average molecular weight of 550 that may be obtained from a 550 molecular weight polyisobutene available from BASF in Ludwigshafen, Germany under the trade name Glissopal 550. Preferably, from about 0.01 wt % to about 1.20 wt % alkyl or alkenyl succinic anhydride is added to the base package. More preferably, from about 0.10 wt % to about 0.75 wt % of alkyl or alkenyl succinic anhydride is added to the base package. Most preferably, from about 0.25 wt % to about 0.60 wt % alkyl or alkenyl succinic anhydride is added to the base package. A thiadiazole, such as a non-alkyl-polycarboxylate moiety-containing 2,5-dimercapto-1,3,4-thiadiazole, is also added to the mixture. Preferably, from about 0.02 wt % to about 0.25 wt % thiadiazole is added to the mixture. More preferably, from about 0.05 wt % to about 0.20 wt % thiadiazole, such as a non-alkyl-polycarboxylate moiety-containing 2,5-dimercapto-1,3,4-thiadiazole, is added to the mixture. Most preferably, from about 0.1 wt % to about 0.18 wt % thiadiazole, such as a non-alkyl-polycarboxylate moiety-containing 2,5-dimercapto-1,3,4-thiadiazole, is added to the mixture. To complete the finished oil, at least one base oil is added to the mixture which comprises the base package, alkyl or alkenyl succinic anhydride, and thiadiazole, such as a non-alkyl-polycarboxylate moiety-containing 2,5-dimercapto-1,3,4-thiadiazole. Preferably, two types of base oil (i.e., 150 bright stock and solvent refined 600N oil) are added. The mixture is mixed at elevated temperatures of about 50° F. to 200° F., preferably about 70° F. to 180° F., for example 150° F., until it is homogenous. After heating, the homogenous mixture is evaluated for copper corrosion according to ASTM D-130 test procedure.

Method of Use of the Present Invention

The present invention is used to decrease the corrosiveness of gear oils towards yellow metals present in axles and transmissions. Specifically, the lubricating oil of the present invention contacts metal components in axles and transmissions to reduce wear and to reduce corrosion of the metal components. Additionally, the lubricating oil composition may be used to top treat an oil that exhibits corrosive properties. The lubricating oil composition of the present invention typically contains about 0.6 to 6.6 wt % of the gear oil additive package of the present invention. Preferably, the lubricating oil of the present invention contains about 2.1 to 4.8 wt % of the gear oil additive package of the present invention. Most preferred, the lubricating oil of the present invention contains about 2.6 to 4.2 wt % of the gear oil additive package of the present invention. The gear oil additive composition will optionally contain sufficient inorganic liquid diluent to make it easy to handle during shipping and storage. Typically, the gear oil additive composition will contain from about 0.0 to 20.0% of the organic liquid diluent and preferably about 3.0 to 15.0 wt %. Suitable organic diluents which can be used include for example, solvent refined 100N (i.e., Cit-con 100N), and hydrotreated 100N (i.e., Chevron 100N), and the like. The organic diluent preferably has a viscosity of about 10 to 20 cSt at 100° C.

Performance Testing

The lubricating gear oil composition of the present invention typically meets ASTM D-130 requirements as part of the API GL-5 performance criteria. ASTM D-130 Test Method is the test that was developed to measure the stability of the lubricating oil in the presence of copper and copper alloys (i.e., extent of copper corrosion). Using ASTM D-130, copper corrosion is measured on a scale of 1 to 4, wherein a result of 1 represents slight tarnish and a result of 4 represents copper corrosion. For API-GL-5 evaluations, a numerical result of 4 fails the ASTM D-130 test, whereas numerical results of 1, 2 or 3 pass the ASTM D-130 test. The lubricating gear oil of the present invention results in copper corrosion less than or equal to 2, passing the ASTM D-130 test.

The following examples are presented to illustrate specific embodiments of this invention and are not to be construed in any way as limiting the scope of the invention.

EXAMPLES

Example 1

Preparation of the Base Package

To a 2 L beaker, 631.58 grams of dialkyl polysulfide, a mixture of di-t-butyl tri-, tetra-, and penta-sulfide, TBPS 454 from Chevron Phillips Chemical Company, was mixed with 368.42 grams of an amine dithiophosphate, as described in Salentine, U.S. Pat. No. 4,575,431, at 100° F. until the mixture was homogenous.

Example 2

To a 1 L beaker, 2.85 wt % (14.25 grams) of the base package of Example 1, 0.25 wt % (1.25 grams) of tetrapropenyl succinic anhydride (total molecular weight 266), 0.15 wt % (0.75 grams) of Hitec® 4313 which is a thiadiazole containing about 4 wt % 2,5-dimercapto-1,3,4-thiadiazole, 16.35 wt % (81.75 grams) Citgo 150 bright stock, and 80.40 wt % (402.00 grams) Exxon 600 N (base oil) were mixed at 150° F. until the mixture was homogenous.

Example 3

To a 1 L beaker, 2.85 wt % (14.25 grams) of the base package of Example 1, 0.25 wt % (1.25 grams) of tetrapropenyl succinic anhydride (total molecular weight 266), 0.15 wt % (0.75 grams) of Lubrizol® 5955A which is a thiadiazole containing about 4 wt % 2,5-dimercapto-1,3,4-thiadiazole, 16.35 wt % (81.75 grams) Citgo 150 bright stock, and 80.40 wt % (402.00 grams) Exxon 600 N (base oil) were mixed at 150° F. until the mixture was homogenous.

Example 4

A second base package was prepared as follows:

To a 400 mL beaker, 46.75 wt % (46.75) grams of dialkyl polysulfide, a mixture of di-t-butyl tri-, tetra-, and penta-sulfide, TBPS 454 from Chevron Phillips Chemical Company, 27.27 wt % (27.27 grams) of amine dithiophospate, as described in Salentine, U.S. Pat. No. 4,575,431, 3.90 wt % (3.90 grams) of Hitec® 4313 which is a thiadiazole containing about 4 wt % 2,5-dimercapto-1,3,4-thiadiazole, 15.58 wt % (15.58 grams) of polyisobutenyl (PIB) succinic anhydride (PIB molecular weight 550), and 6.50 wt % (6.50 grams) of Exxon 100 N (base oil) were mixed at 100° F. until the mixture was homogenous.

To a 600 mL beaker, 3.85 wt % (7.70 grams) of the second base package as described above, 15.00 wt % (30.00 grams) of Citgo 150 bright stock (base oil) and 81.15 wt % (162.30 grams) of Exxon 600 N (base oil) were mixed at 130° F. until the mixture was homogenous.

Example 5

To a 1 L beaker, 2.85 wt % (14.25 grams) of the base package of Example 1, 0.60 wt % (3.00 grams) of polyisobutenyl (PIB) succinic anhydride (PIB molecular weight 550), 0.15 wt % (0.75 grams) of Lubrizol® 5955A which is a thiadiazole containing about 4 wt % 2,5-dimercapto-1,3,4-thiadiazole, 16.00 wt % (80.00 grams) Citgo 150 bright stock, and 80.40 wt % (402.00 grams) Exxon 600 N (base oil) were mixed at 150° F. until the mixture was homogenous.

Example 6

To a 1 L beaker, 2.85 wt % (14.25 grams) of the base package of Example 1, 0.60 wt % (3.00 grams) of polyisobutenyl (PIB) succinic anhydride (PIB molecular weight 550), 0.15 wt % (0.75 grams) of Hitec® 4313 which is a thiadiazole containing about 4 wt % 2,5-dimercapto-1,3,4-thiadiazole, 16.00 wt % (80.00 grams) Citgo 150 bright stock, and 80.40 wt % (402.00 grams) Exxon 600 N (base oil) were mixed at 150° F. until the mixture was homogenous.

COMPARATIVE EXAMPLES

Comparative Examples A–S contain at least one of the following variants: 2300 molecular weight polyisobutenyl succinic anhydrides (PIBSA); no thiadiazole and/or no PIBSA; more than 0.25 wt % thiadizole and no PIBSA; no amine dithiophosphate and 1000 molecular weight PIBSA.

Example A

To a 1 L beaker, 2.85 wt % (14.25 grams) of the base package of Example 1, 0.60 wt % (3.00 grams) of polyisobutenyl (PIB) succinic anhydride (PIB molecular weight 2300), 0.15 wt % (0.75 grams) of Hitec® 4313 which is a thiadiazole containing about 4 wt % 2,5-dimercapto-1,3,4-thiadiazole, 16.00 wt % (80.00 grams) Citgo 150 bright stock, and 80.40 wt % (402.00 grams) Exxon 600 N (base oil) were mixed at 150° F. until the mixture was homogenous.

Example B

To a 1 L beaker, 2.85 wt % (14.25 grams) of the base package of Example 1, 0.60 wt % (3.00 grams) of polyisobutenyl (PIB) succinic anhydride (PIB molecular weight 2300), 0.15 wt % (0.75 grams) of Lubrizol® 5955A which is a thiadiazole containing about 4 wt % 2,5-dimercapto-1,3,4-thiadiazole, 16.00 wt % (80.00 grams) Citgo 150 bright stock, and 80.40 wt % (402.00 grams) Exxon 600 N (base oil) were mixed at 150° F. until the mixture was homogenous.

Example C

To a 1 L beaker, 2.85 wt % (14.25 grams) of the base package of Example 1, 16.00 wt % (80.00 grams) Citgo 150 bright stock, and 81.15 wt % (405.75 grams) Exxon 600 N (base oil) were mixed at 150° F. until the mixture was homogenous.

Example D

A third base package was prepared as follows: To a 1 L beaker, 57.14 wt % (285.72 grams) of dialkyl polysulfide, a mixture of di-t-butyl tri-, tetra-, and penta-sulfide, TBPS 454 from Chevron Phillips Chemical Company, 33.33 wt % (166.66 grams) of amine dithiophosphate, as described in Salentine, U.S. Pat. No. 4,575,431, and 9.53 wt % (47.62 grams) of Hitec® 4313, which is a thiadiazole containing about 4 wt % 2,5-dimercapto-1,3,4-thiadiazole, were mixed at 100° F. until the mixture was homogenous.

To a 5-gallon stainless steel vessel, 3.15 wt % (378.0 grams) of the third base package as described above, 12.80 wt % (1,536.0 grams) of Citgo 150 bright stock (base oil), and 84.05 wt % (10,086.0 grams) of Exxon 600 N (base oil) were mixed at 130° F. until the mixture was homogenous.

Example E

A fourth base package was prepared as follows: To a 400 mL beaker, 57.69 wt % (57.69 grams) of dialkyl polysulfide, a mixture of di-t-butyl tri-, tetra-, and penta-sulfide, TBPS 454 from Chevron Phillips Chemical Company, 33.65 wt % (33.65 grams) of amine dithiophosphate, as described in Salentine, U.S. Pat. No. 4,575,431, and 8.66 wt % (8.66 grams) of Hitec 4313, which is a thiadiazole containing about 4 wt % 2,5-dimercapto-1,3,4-thiadiazole, were mixed at 100° F. until the mixture was homogenous.

To a 600 mL beaker, 3.12 wt % (6.24 grams) of the fourth base package as described above, 12.83 wt % (25.66 grams) of Citgo 150 bright stock (base oil), and 84.05 wt % (168.10 grams) of Exxon 600 N (base oil) were mixed at 130° F. until the mixture was homogenous.

Example F

To a 1 L beaker, 2.85 wt % (14.25 grams) of the base package of Example 1, 0.6 wt % (3.00 grams) of polyisobutenyl (PIB) succinic anhydride (PIB molecular weight 550), 16.00 wt % (80.00 grams) Citgo 150 bright stock, and 81.15 wt % (405.75 grams) Exxon 600 N (base oil) were mixed at 150° F. until the mixture was homogenous.

Example G

To a 1 L beaker, 2.85 wt % (14.25 grams) of the base package of Example 1, 0.6 wt % (3.00 grams) of polyisobutenyl (PIB) succinic anhydride (PIB molecular weight 550), 0.10 wt % (0.50 grams) of Hitec® 4313, which is a thiadiazole containing about 4 wt % 2,5-dimercapto-1,3,4-thiadiazole, 16.00 wt % (80.00 grams) Citgo 150 bright stock, and 80.45 wt % (402.25 grams) Exxon 600 N (base oil) were mixed at 150° F. until the mixture was homogenous.

Example H

To a 1 L beaker, 2.85 wt % (14.25 grams) of the base package of Example 1, 0.15 wt % (0.75 grams) of Hitec® 4313 which is a thiadiazole containing about 4 wt % 2,5-dimercapto-1,3,4-thiadiazole, 16.00 wt % (80.00 grams) Citgo 150 bright stock, and 81.00 wt % (405.00 grams) Exxon 600 N (base oil) were mixed at 150° F. until the mixture was homogenous.

Example I

To a 1 L beaker, 2.85 wt % (14.25 grams) of the base package of Example 1, 0.60 wt % (3.00 grams) of polyisobutenyl (PIB) succinic anhydride (PIB molecular weight 550), 0.15 wt % (0.75 grams) of Vanlube 871 which is a thiadiazole containing 2,5-dimercapto-1,3,4-thiadiazole having an alkyl polycarboxylate moiety, 16.00 wt % (80.00 grams) Citgo 150 bright stock, and 80.40 wt % (402.00 grams) Exxon 600 N (base oil) were mixed at 150° F. until the mixture was homogenous.

Example J

To a 1 L beaker, 2.85 wt % (14.25 grams) of the base package of Example 1, 0.60 wt % (3.00 grams) of polyisobutenyl (PIB) succinic anhydride (PIB molecular weight 550), 0.15 wt % (0.75 grams) of Mobilad C610 which is a thiadiazole containing approximately 0.01 wt % 2,5-dimercapto-1,3,4-thiadiazole, 16.00 wt % (80.00 grams) Citgo 150 bright stock, and 80.40 wt % (402.00 grams) Exxon 600 N (base oil) were mixed at 150° F. until the mixture was homogenous.

Example K

To a 1 L beaker, 2.85 wt % (14.25 grams) of the base package of Example 1, 0.60 wt % (3.00 grams) of polyisobutenyl (PIB) succinic anhydride (PIB molecular weight 1000), 0.15 wt % (0.75 grams) of Vaniube 871 which is a thiadiazole containing 2,5-dimercapto-1,3,4-thiadiazole having an alkyl polycarboxylate moiety, 16.00 wt % (80.00 grams) Citgo 150 bright stock, and 80.40 wt % (402.00 grams) Exxon 600 N (base oil) were mixed at 150° F. until the mixture was homogenous.

Example L

To a 1 L beaker, 2.85 wt % (14.25 grams) of the base package of Example 1, 0.60 wt % (3.00 grams) of polyisobutenyl (PIB) succinic anhydride (PIB molecular weight 1000), 0.15 wt % (0.75 grams) of Lubrizol® 5955A which is a thiadiazole containing about 4 wt % 2,5-dimercapto-1,3,4-thiadiazole, 16.00 wt % (80.00 grams) Citgo 150 bright stock, and 80.40 wt % (402.00 grams) Exxon 600 N (base oil) were mixed at 150° F. until the mixture was homogenous.

Example M

To a 1 L beaker, 2.85 wt % (14.25 grams) of the base package of Example 1, 0.60 wt % (3.00 grams) of polyisobutenyl (PIB) succinic anhydride (PIB molecular weight 1000), 0.15 wt % (0.75 grams) of Hitec® 4313 which is a thiadiazole containing about 4 wt % 2,5-dimercapto-1,3,4-thiadiazole, 16.00 wt % (80.00 grams) Citgo 150 bright stock, and 80.40 wt % (402.00 grams) Exxon 600 N (base oil) were mixed at 150° F. until the mixture was homogenous.

Example N

To a 1 L beaker, 2.85 wt % (14.25 grams) of the base package of Example 1, 0.60 wt % (3.00 grams) of polyisobutenyl (PIB) succinic anhydride (PIB molecular weight 1000), 0.15 wt % (0.75 grams) of Mobilad C610 which is a thiadiazole containing about 0.01 wt % 2,5-dimercapto-1,3,4-thiadiazole, 16.00 wt % (80.00 grams) Citgo 150 bright stock, and 80.40 wt % (402.00 grams) Exxon 600 N (base oil) were mixed at 150° F. until the mixture was homogenous.

Example O

To a 1 L beaker, 2.85 wt % (14.25 grams) of the base package of Example 1, 1.20 wt % (6.00 grams) of polyisobutenyl (PIB) succinic anhydride (PIB molecular weight 1000), 0.15 wt % (0.75 grams) of Vanlube 871 which is a thiadiazole containing 2,5-dimercapto-1,3,4-thiadiazole having an alkyl polycarboxylate moiety, 16.00 wt % (80.00 grams) Citgo 150 bright stock, and 80.40 wt?!% (402.00 grams) Exxon 600 N (base oil) were mixed at 150° F. until the mixture was homogenous.

Example P

To a 1 L beaker, 2.85 wt % (14.25 grams) of the base package of Example 1, 1.20 wt % (6.00 grams) of polyisobutenyl (PIB) succinic anhydride (PIB molecular weight 1000), 0.15 wt % (0.75 grams) of Lubrizol® 5955A which is a thiadiazole containing about 4 wt % 2,5-dimercapto-1,3,4-thiadiazole, 16.00 wt % (80.00 grams) Citgo 150 bright stock, and 80.40 wt % (402.00 grams) Exxon 600 N (base oil) were mixed at 150° F. until the mixture was homogenous.

Example Q

To a 1 L beaker, 2.85 wt % (14.25 grams) of the base package of Example 1, 1.20 wt % (6.00 grams) of polyisobutenyl (PIB) succinic anhydride (PIB molecular weight 1000), 0.15 wt % (0.75 grams) of Hitec® 4313 which is a thiadiazole containing about 4 wt % 2,5-dimercapto-1,3,4-thiadiazole, 16.00 wt % (80.00 grams) Citgo 150 bright stock, and 80.40 wt % (402.00 grams) Exxon 600 N (base oil) were mixed at 150° F. until the mixture was homogenous.

Example R

To a 1 L beaker, 2.85 wt % (14.25 grams) of the base package of Example 1, 1.20 wt % (6.00 grams) of polyisobutenyl (PIB) succinic anhydride (PIB molecular weight 1000), 0.15 wt % (0.75 grams) of Mobilad C610 which is a thiadiazole containing about 0.01 wt % 2,5-dimercapto-1,3,4-thiadiazole, 16.00 wt % (80.00 grams) Citgo 150 bright stock, and 80.40 wt % (402.00 grams) Exxon 600 N (base oil) were mixed at 150° F. until the mixture was homogenous.

Example S

A fifth base package was prepared as follows:

To a 200 mL beaker, 81.82 wt % (40.91 grams) of dialkyl polysulfide, a mixture of di-t-butyl, tri-, tetra-, and pentasulfide, TBPS 454 from Chevron Phillips Chemical Company, 6.92 wt % (3.41 grams) of Hitec® 4313 which is a thiadiazole containing about 4 wt % 2,5-dimercapto-1,3,4-thiadiazole, 11.36 wt % (5.68 grams) of tetrapropenyl succinic anhydride (total molecular weight 266) were mixed at 100° F. until the mixture was homogenous.

To a 1,000 mL beaker, 2.2 wt % (11.0 grams) of the additive package above described, 19.56 wt % (97.80 grams) of Citgo 150 bright stock (base oil), and 78.24 wt % (391.20 grams) of Exxon 600 N (base oil) were mixed at 130° F. until the mixture was homogenous.

PERFORMANCE RESULTS

Example 2

The composition of this example was evaluated for copper corrosion according to ASTM D-130. The ASTM D-130 rating was 2a, passing the GL-5 requirements for copper corrosion test.

Example 3

The composition of this example was evaluated for copper corrosion according to ASTM D-130. The ASTM D-130 rating was 1b, passing the GL-5 requirements for copper corrosion test. The ASTM D-130 test was repeated three more times. Each result produced a rating of 1b, passing the GL-5 requirements for copper corrosion test.

Example 4

The composition of this example was evaluated for copper corrosion according to ASTM D-130. The ASTM D-130 rating was 1b, passing the GL-5 requirements for copper corrosion test.

Example 5

The composition of this example was evaluated for copper corrosion according to ASTM D-130. The ASTM D-130 rating was 2c, passing the GL-5 requirements for copper corrosion test. The ASTM D-130 test was repeated. This result produced a rating of 2a, passing the GL-5 requirements for copper corrosion test.

Example 6

The composition of this example was evaluated for copper corrosion according to ASTM D-130. The ASTM D-130 rating was 2c, passing the GL-5 requirements for copper corrosion test. The ASTM D-130 test was repeated. This result produced a rating of 2e, passing the GL-5 requirements for copper corrosion test.

PERFORMANCE RESUOTS—COMPARATIVE EXAMPLES

Example A

The composition of this example was evaluated for copper corrosion according to ASTM D-130. The ASTM D-130 rating was 4b, failing the GL-5 requirements for copper corrosion test.

Example B

The composition of this example was evaluated for copper corrosion according to ASTM D-130. The ASTM D-130 rating was 4c, failing the GL-5 requirements for copper corrosion test.

Example C

The composition of this example was evaluated for copper corrosion according to ASTM D-130. The ASTM D-130 rating was 4b, failing the GL-5 requirements for copper corrosion test. The ASTM D-130 test was repeated. This result produced a rating of 4b, failing the GL-5 requirements for copper corrosion test.

Example D

The composition of this example was evaluated for copper corrosion according to ASTM D-130. The ASTM D-130 rating was 2e, passing the GL-5 requirements for copper corrosion test. This example passed the test because it contained twice the amount of thiadiazole and no polyisobutenyl succinic anhydride. The present invention contains less thiadiazole and an alkyl or alkenyl succinic anhydride.

Example E

The composition of this example was evaluated for effect copper corrosion according to ASTM D-130. The ASTM D-130 rating was 4b, failing the GL-5 requirements for copper corrosion test.

Example F

The composition of this example was evaluated for copper corrosion according to ASTM D-130. The ASTM D-130 rating was 4b, failing the GL-5 requirements for copper corrosion test. The ASTM D-130 test was repeated. This result produced a rating of 4b, failing the GL-5 requirements for copper corrosion test.

Example G

The composition of this example was evaluated for copper corrosion according to ASTM D-130. The ASTM D-130 rating was 4b, failing the GL-5 requirements for copper corrosion test. The ASTM D-130 test was repeated. This result produced a rating of 4b, failing the GL-5 requirements for copper corrosion test.

Example H

The composition of this example was evaluated for copper corrosion according to ASTM D-130. The ASTM D-130 rating was 4b, failing the GL-5 requirements for copper corrosion test. The ASTM D-130 test was repeated. This result produced a rating of 4b, failing the GL-5 requirements for copper corrosion test.

Example I

The composition of this example was evaluated for copper corrosion according to ASTM D-130. The ASTM D-130 rating was 4b, failing the GL-5 requirements for copper corrosion test. The ASTM D-130 test was repeated. This result produced a rating of 4b, failing the GL-5 requirements for copper corrosion test.

Example J

The composition of this example was evaluated for copper corrosion according to ASTM D-130. The ASTM D-130 rating was 4b, failing the GL-5 requirements for copper corrosion test. The ASTM D-130 test was repeated. This result produced a rating of 4b, failing the GL-5 requirements for copper corrosion test.

Example K

The composition of this example was evaluated for copper corrosion according to ASTM D-130. The ASTM D-130 rating was 4b, failing the GL-5 requirements for copper corrosion test. The ASTM D-130 test was repeated. This result produced a rating of 4b, failing the GL-5 requirements for copper corrosion test.

Example L

The composition of this example was evaluated for copper corrosion according to ASTM D-130. An ASTM D-130 rating was 4b, failing the GL-5 requirements for copper corrosion test. The ASTM D-130 test was repeated. This result produced a rating of 4b, failing the GL-5 requirements for copper corrosion test.

Example M

The composition of this example was evaluated for copper corrosion according to ASTM D-130. An ASTM D-130 rating was 4b, failing the GL-5 requirements for copper corrosion test. The ASTM D-130 test was repeated. This result produced a rating of 4b, failing the GL-5 requirements for copper corrosion test.

Example N

The composition of this example was evaluated for copper corrosion according to ASTM D-130. The ASTM D-130 rating was 4b, failing the GL-5 requirements for copper corrosion test. The ASTM D-130 test was repeated. This result produced a rating of 4b, failing the GL-5 requirements for copper corrosion test.

Example O

The composition of this example was evaluated for copper corrosion according to ASTM D-130. The ASTM D-130 rating was 4b, failing the GL-5 requirements for copper corrosion test. The ASTM D-130 test was repeated. This result produced a rating of 4b, failing the GL-5 requirements for copper corrosion test.

Example P

The composition of this example was evaluated for copper corrosion according to ASTM D-130. An ASTM D-130 rating was 4b, failing the GL-5 requirements for copper corrosion test. The ASTM D-130 test was repeated. This result produced a rating of 4b, failing the GL-5 requirements for copper corrosion test.

Example Q

The composition of this example was evaluated for copper corrosion according to ASTM D-130. An ASTM D-130 rating was 4b, failing the GL-5 requirements for copper corrosion test. The ASTM D-130 test was repeated. This result produced a rating of 4b, failing the GL-5 requirements for copper corrosion test.

Example R

The composition of this example was evaluated for copper corrosion according to ASTM D-130. The ASTM D-130 rating was 4b, failing the GL-5 requirements for copper corrosion test. The ASTM D-130 test was repeated. This result produced a rating of 4b, failing the GL-5 requirements for copper corrosion test.

Example S

The composition of this example was evaluated for copper corrosion according to ASTM D-130. The ASTM D-130 rating was 4b, failing the GL-5 requirements for copper corrosion test.

What is claimed is:

1. A lubricating oil composition comprising:

(a) a major amount of an oil of lubricating viscosity;

(b) from about 0.25 to about 3.6 wt % organic sulfur-containing extreme pressure additive;

(c) from about 0.3 to about 1.5 wt % amino phosphorus compound;

(d) from about 0.01 to about 1.2 wt % alkyl or alkenyl succinic anhydride, wherein the alkyl or alkenyl group has a number average molecular weight of about 176 to about 550; and (e) from about 0.15 wt % to about 0.25 wt % thiadiazole, wherein the thiadiazole does not contain a polycarboxylate moiety and the amount of dimercaptothiadiazole present in the thiadiazole is from about 0.1 wt % to about 10 wt %.

2. The lubricating composition according to claim 1 wherein the organic sulfur-containing extreme pressure additive is a mixture of di-t-butyl tri-, tetra-, and penta-sulfide.

3. The lubricating composition according to claim 1 wherein said alkenyl succinic anhydride is tetrapropenyl succinic anhydride.

4. The lubricating composition according to claim 1 wherein said alkenyl succinic anhydride is polyisobutenyl succinic anhydride.

5. The lubricating composition according to claim 1 comprising:

(a) a major amount of oil of lubricating viscosity;

(b) from about 1.2 to about 2.6 wt % organic sulfur-containing extreme pressure additive;

(c) from about 0.7 to about 1.3 wt % amino phosphorus compound;

(d) from about 0.1 to about 0.75 wt % alkyl or alkenyl succinic anhydride, wherein the alkyl or alkenyl group has a number average molecular weight of about 176 to about 550; and (e) from about 0.15 wt % to about 0.2 wt % thiadiazole, wherein the thiadiazole does not contain a polycarboxylate moiety and the amount of dimercaptothiadiazole present in the thiadiazole is from about 0.1 wt % to about 10 wt %.

6. The lubricating composition according to claim 5 comprising:

(a) a major amount of oil of lubricating viscosity;

(b) from about 1.4 wt % to about 2.2 wt % organic sulfur-containing extreme pressure additive;

(c) from about 0.8 wt % to about 1.2 wt % amino phosphorus compound;

(d) from about 0.25 to about 0.6 wt % alkyl or alkenyl succinic anhydride, wherein the alkyl or alkenyl group has a number average molecular weight of about 176 to about 550; and (e) from about 0.15 wt % to about 0.18 wt % thiadiazole, wherein the thiadiazole does not contain a polycarboxylate moiety and the amount of dimercaptothiadiazole present in the thiadiazole is from about 0.1 wt % to about 10 wt %.

7. A method of reducing yellow metal corrosion in metal components in axles and transmissions comprising contacting the metal components with the lubricating oil composition of claim 1.

8. A method of making an oil-soluble additive composition comprising:

(a) preparing a base package by mixing an organic sulfur-containing extreme pressure additive with an amino phosphorus compound; and (b) mixing the product of (a) with an alkyl or alkenyl succinic anhydride, wherein the alkyl or alkenyl group has a number average molecular weight of about 176 to about 550, and from about 0.15 wt % to about 0.25 wt % thiadiazole, wherein the thiadiazole does not contain a polycarboxylate moiety and the amount of dimercaptothiadiazole present in the thiadiazole is from about 0.1 wt % to about 10 wt %.

9. The method according to claim 8 wherein said alkyl or alkenyl succinic anhydride is polyisobutenyl succinic anhydride wherein the polyisobutenyl group has a number average molecular weight of about 250 to 550.

10. The method according to claim 8 wherein said alkyl or alkenyl succinic anhydride is tetrapropenyl succinic anhydride.

11. A method of making a lubricating oil composition comprising:

(a) preparing a base package by mixing an organic sulfur-containing extreme pressure additive with amino phosphorus compound;

(b) mixing the product of (a) with an alkyl or alkenyl succinic anhydride, wherein the alkyl or alkenyl group has a number average molecular weight of about 176 to about 550, and from about 0.15 wt % to about 0.25 wt % thiadiazole, wherein the thiadiazole does not contain a polycarboxylate moiety and the amount of dimercaptothiadiazole present in the thiadiazole is from about 0.1 wt % to about 10 wt %; and (c) combining the product of (b) with a major amount of oil of lubricating viscosity.

12. The method according to claim 11 wherein from about 0.01 wt % to about 1.2 wt % alkyl or alkenyl succinic anhydride is added to the product of (a) and mixed with thiadiazole, wherein the thiadiazole does not contain a polycarboxylate moiety and the amount of dimercaptothiadiazole present in the thiadiazole is from about 0.1 wt % to about 10 wt %.

13. The method according to claim 11 wherein from about 0.02 wt % to about 0.25 wt % thiadiazole, wherein the thiadiazole does not contain a polycarboxylate moiety and the amount of dimercaptothiadiazole present in the thiadiazole is from about 0.1 wt % to about 10 wt %, is added to the product of (a) and mixed with alkyl or alkenyl succinic anhydride.

14. A method of making a lubricating oil composition comprising:

(a) mixing an organic sulfur-containing extreme pressure additive, an amino phosphorus compound, an alkyl or alkenyl succinic anhydride, wherein the alkyl or alkenyl group has a number average molecular weight of about 176 to about 550, and from about 0.15 wt % to about 0.25 wt % thiadiazole, wherein the thiadiazole does not contain a polycarboxylate moiety and the amount of dimercaptothiadiazole present in the thiadiazole is from about 0.1 wt % to about 10 wt %, until the mixture is homogenous; and (b) adding at least 90 wt % base oil to the mixture of (a).

15. The method according to claim 14 wherein said alky or alkenyl succinic anhydride is polyisobutenyl succinic anhydride wherein the polyisobutenyl group has a number average molecular weight of about 250 to 550.

16. The method according to claim 14 wherein said alkyl or alkenyl succinic anhydride is tetrapropenyl succinic anhydride.

* * * * *